US007310971B2

(12) United States Patent
Eaton et al.

(10) Patent No.: US 7,310,971 B2
(45) Date of Patent: Dec. 25, 2007

(54) LNG SYSTEM EMPLOYING OPTIMIZED HEAT EXCHANGERS TO PROVIDE LIQUID REFLUX STREAM

(75) Inventors: Anthony P. Eaton, Sugar Land, TX (US); David Messersmith, Houston, TX (US)

(73) Assignee: ConocoPhillips Company, Houston, TX (US)

( * ) Notice: Subject to any disclaimer, the term of this patent is extended or adjusted under 35 U.S.C. 154(b) by 145 days.

(21) Appl. No.: 10/972,795

(22) Filed: Oct. 25, 2004

(65) Prior Publication Data

US 2006/0086139 A1 Apr. 27, 2006

(51) Int. Cl.
*F25J 1/00* (2006.01)

(52) U.S. Cl. ..... 62/613; 62/614; 62/611; 62/630; 62/627; 62/903; 165/166

(58) Field of Classification Search ..... 62/611, 62/612, 613, 614, 618, 620
See application file for complete search history.

(56) References Cited

U.S. PATENT DOCUMENTS 3,407,052 A 10/1968 Huntress et al.
4,435,198 A * 3/1984 Gray ..... 62/622
5,385,203 A * 1/1995 Mitsuhashi et al. ..... 165/110
5,613,373 A 3/1997 Grenier
5,813,250 A 9/1998 Ueno et al.
6,021,647 A * 2/2000 Ameringer et al. ..... 62/631
6,105,389 A 8/2000 Paradowski et al.
6,289,692 B1 * 9/2001 Houser et al. ..... 62/613
6,349,566 B1 * 2/2002 Howard et al. ..... 62/627

* cited by examiner

*Primary Examiner*—Cheryl Tyler
*Assistant Examiner*—John Pettitt
(74) *Attorney, Agent, or Firm*—Hovey Williams LLP

(57) ABSTRACT

An improved apparatus and method for providing reflux to a refluxed heavies removal column of a LNG facility. The apparatus comprises stacked vertical core-in-kettle heat exchangers and an economizer disposed between the heat exchangers. The reflux stream originates from the methane-rich refrigerant of the methane refrigeration cycle. The liquid reflux stream generated by cooling the methane-rich stream in the vertical heat exchangers via indirect heat exchange with an upstream refrigerant.

11 Claims, 5 Drawing Sheets

LNG SYSTEM EMPLOYING OPTIMIZED HEAT EXCHANGERS TO PROVIDE LIQUID REFLUX STREAM

BACKGROUND OF THE INVENTION

1. Field of the Invention

This invention relates to a method and apparatus for liquefying natural gas. In another aspect, the invention concerns an method and apparatus for providing liquid reflux to a refluxed heavies removal column of a liquefied natural gas (LNG) facility.

2. Description of the Prior Art

The cryogenic liquefaction of natural gas is routinely practiced as a means of converting natural gas into a more convenient form for transportation and storage. Such liquefaction reduces the volume of the natural gas by about 600-fold and results in a product which can be stored and transported at near atmospheric pressure.

Natural gas is frequently transported by pipeline from the supply source of supply to a distant market. It is desirable to operate the pipeline under a substantially constant and high load factor but often the deliverability or capacity of the pipeline will exceed demand while at other times the demand may exceed the deliverability of the pipeline. In order to shave off the peaks where demand exceeds supply or the valleys when supply exceeds demand, it is desirable to store the excess gas in such a manner that it can be delivered when demand exceeds supply. Such practice allows future demand peaks to be met with material from storage. One practical means for doing this is to convert the gas to a liquefied state for storage and to then vaporize the liquid as demand requires.

The liquefaction of natural gas is of even greater importance when transporting gas from a supply source which is separated by great distances from the candidate market and a pipeline either is not available or is impractical. This is particularly true where transport must be made by ocean-going vessels. Ship transportation in the gaseous state is generally not practical because appreciable pressurization is required to significantly reduce the specific volume of the gas. Such pressurization requires the use of more expensive storage containers.

In order to store and transport natural gas in the liquid state, the natural gas is preferably cooled to −240° F. to −260° F. where the liquefied natural gas (LNG) possesses a near-atmospheric vapor pressure. Numerous systems exist in the prior art for the liquefaction of natural gas in which the gas is liquefied by sequentially passing the gas at an elevated pressure through a plurality of cooling stages whereupon the gas is cooled to successively lower temperatures until the liquefaction temperature is reached. Cooling is generally accomplished by indirect heat exchange with one or more refrigerants such as propane, propylene, ethane, ethylene, methane, nitrogen, carbon dioxide, or combinations of the preceding refrigerants (e.g., mixed refrigerant systems). A liquefaction methodology which is particularly applicable to the current invention employs an open methane cycle for the final refrigeration cycle wherein a pressurized LNG-bearing stream is flashed and the flash vapors (i.e., the flash gas stream(s)) are subsequently employed as cooling agents, recompressed, cooled, combined with the processed natural gas feed stream and liquefied thereby producing the pressurized LNG-bearing stream.

In most LNG facilities it is necessary to remove heavy components (e.g., benzene, toluene, xylene, and/or cyclohexane) from the processed natural gas stream in order to prevent freezing of the heavy components in downstream heat exchangers. It is known that refluxed heavies columns can provide significantly more effective and efficient heavies removal than non-refluxed columns. However, many existing LNG facilities were originally constructed with non-refluxed heavies removal columns. Thus, it would be desirable to retrofit existing LNG facilities employing non-refluxed heavies removal columns with refluxed heavies removal columns.

One problem with retrofitting an existing LNG facility with a refluxed heavies removal column is the lack of availability of a suitable reflux stream. The reflux stream to a heavies removal column must be a low-temperature, liquid, methane-rich stream. It is not economically feasible to use existing liquified methane-rich steams of conventional LNG facilities as reflux to the heavies removal column because such liquid streams are typically at low pressures. A cryogenic pump would be required to transport these existing low-pressure, methan-rich streams to the heavies removal column. It is well know that cryogenic pumps are very expensive, and the cost of employing an additional cryogenic pump in an LNG facility would likely outweigh the benefits of switching from a non-refluxed to a refluxed heavies removal column.

If an existing high-pressure, methane-rich stream could be employed as the reflux stream to the heavies removal column, the need for a cryogenic pump could be obviated because the elevated pressure of the steam could be used to transport it to the heavies removal column. In existing LNG facilities, however, such high-pressure, methane-rich streams are not liquid streams, and current LNG facilities do not have the excess cooling capacity to liquify such high-pressure, methane-rich streams.

OBJECTS AND SUMMARY OF THE INVENTION

It is, therefore, an object of the present invention to provide a method and apparatus for providing a methane-rich liquid reflux stream to a heavies removal column in an LNG facility.

A further object of the invention is to provide a method and apparatus that adds cooling capacity to an existing LNG facility at minimal expense.

Still another object of the invention is to provide an apparatus that adds cooling capacity to an existing LNG facility and occupies minimal plot space in the LNG facility.

It should be understood that the above objects are exemplary and need not all be accomplished by the invention claimed herein. Other objects and advantages of the invention will be apparent from the written description and drawings.

BRIEF DESCRIPTION OF THE DRAWING FIGURES

A preferred embodiment of the present invention is described in detail below with reference to the attached drawing figures, wherein.

Figure 4:
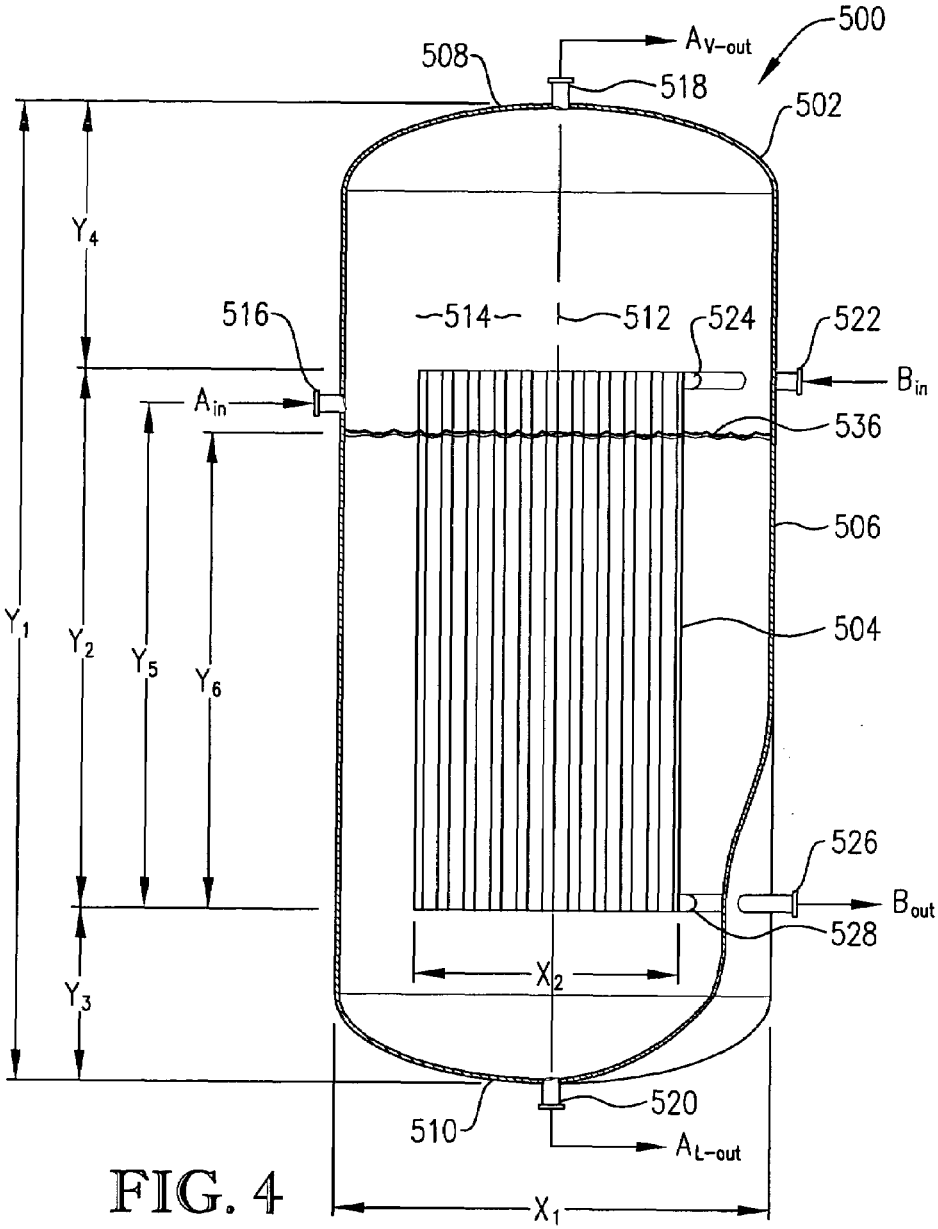
FIG. 4 is a cut-away sided view of a vertical core-in-kettle heat exchanger that can be used in the reflux tower.
Figure 5:
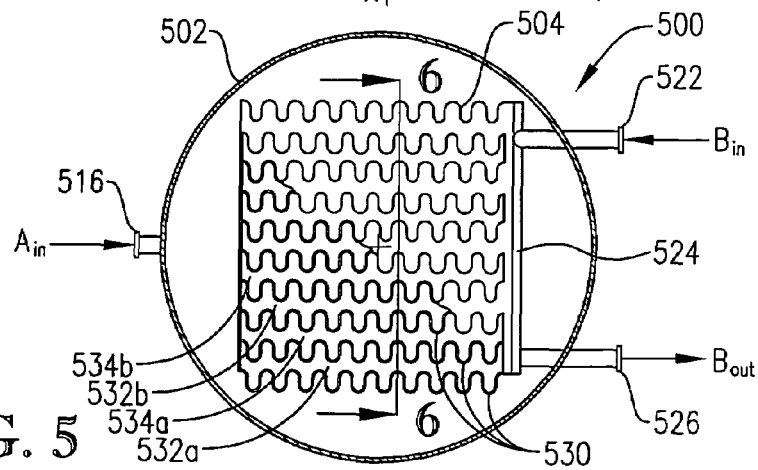
Figure 6:
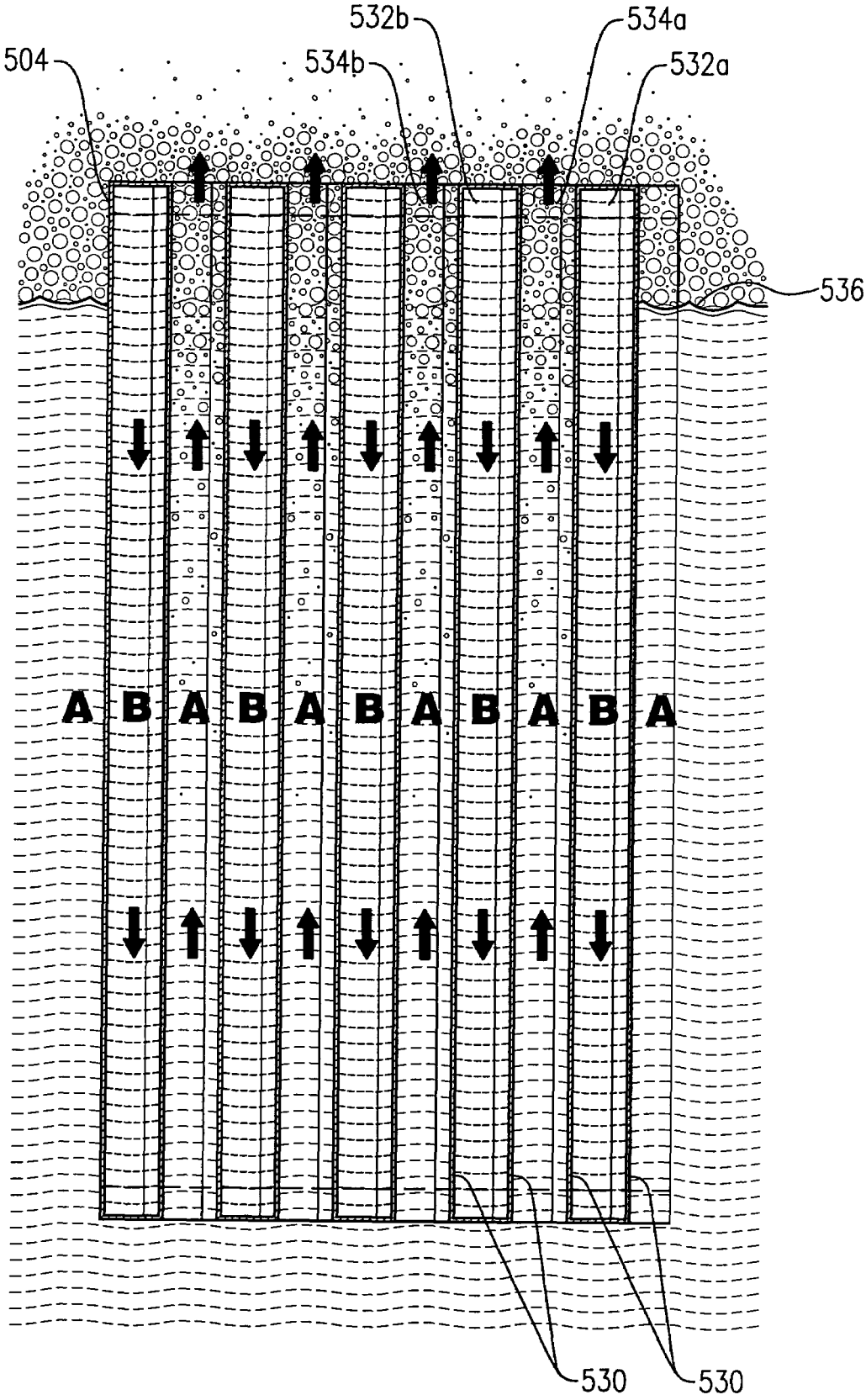

FIG. 5 is a sectional top view of the vertical core-in-kettle heat exchanger of FIG. 4, with the top of the core being partially cut away to more clearly illustrated the alternating shell-side and core-side passageways formed within the core; and FIG. 6 is a sectional side view taken along line 6-6 in FIG. 5, particularly illustrating the direction of flow of the core-side and shell-side fluids through the core, as well as illustrating the thermosiphon effect caused by the boiling of the shell-side fluid in the core.

DETAILED DESCRIPTION OF THE PREFERRED EMBODIMENT

A cascaded refrigeration process uses one or more refrigerants for transferring heat energy from the natural gas stream to the refrigerant and ultimately transferring said heat energy to the environment. In essence, the overall refrigeration system functions as a heat pump by removing heat energy from the natural gas stream as the stream is progressively cooled to lower and lower temperatures. The design of a cascaded refrigeration process involves a balancing of thermodynamic efficiencies and capital costs. In heat transfer processes, thermodynamic irreversibilities are reduced as the temperature gradients between heating and cooling fluids become smaller, but obtaining such small temperature gradients generally requires significant increases in the amount of heat transfer area, major modifications to various process equipment, and the proper selection of flow rates through such equipment so as to ensure that both flow rates and approach and outlet temperatures are compatible with the required heating/cooling duty.

As used herein, the term open-cycle cascaded refrigeration process refers to a cascaded refrigeration process comprising at least one closed refrigeration cycle and one open refrigeration cycle where the boiling point of the refrigerant/cooling agent employed in the open cycle is less than the boiling point of the refrigerating agent or agents employed in the closed cycle(s) and a portion of the cooling duty to condense the compressed open-cycle refrigerant/cooling agent is provided by one or more of the closed cycles. In the current invention, a predominately methane stream is employed as the refrigerant/cooling agent in the open cycle. This predominantly methane stream originates from the processed natural gas feed stream and can include the compressed open methane cycle gas streams. As used herein, the terms "predominantly", "primarily", "principally", and "in major portion", when used to describe the presence of a particular component of a fluid stream, shall mean that the fluid stream comprises at least 50 mole percent of the stated component. For example, a "predominantly" methane stream, a "primarily" methane stream, a stream "principally" comprised of methane, or a stream comprised "in major portion" of methane each denote a stream comprising at least 50 mole percent methane.

One of the most efficient and effective means of liquefying natural gas is via an optimized cascade-type operation in combination with expansion-type cooling. Such a liquefaction process involves the cascade-type cooling of a natural gas stream at an elevated pressure, (e.g., about 650 psia) by sequentially cooling the gas stream via passage through a multistage propane cycle, a multistage ethane or ethylene cycle, and an open-end methane cycle which utilizes a portion of the feed gas as a source of methane and which includes therein a multistage expansion cycle to further cool the same and reduce the pressure to near-atmospheric pressure. In the sequence of cooling cycles, the refrigerant having the highest boiling point is utilized first followed by a refrigerant having an intermediate boiling point and finally by a refrigerant having the lowest boiling point. As used herein, the terms "upstream" and "downstream" shall be used to describe the relative positions of various components of a natural gas liquefaction plant along the flow path of natural gas through the plant.

Various pretreatment steps provide a means for removing undesirable components, such as acid gases, mercaptan, mercury, and moisture from the natural gas feed stream delivered to the LNG facility. The composition of this gas stream may vary significantly. As used herein, a natural gas stream is any stream principally comprised of methane which originates in major portion from a natural gas feed stream, such feed stream for example containing at least 85 mole percent methane, with the balance being ethane, higher hydrocarbons, nitrogen, carbon dioxide, and a minor amount of other contaminants such as mercury, hydrogen sulfide, and mercaptan. The pretreatment steps may be separate steps located either upstream of the cooling cycles or located downstream of one of the early stages of cooling in the initial cycle. The following is a non-inclusive listing of some of the available means which are readily known to one skilled in the art. Acid gases and to a lesser extent mercaptan are routinely removed via a sorption process employing an aqueous amine-bearing solution. This treatment step is generally performed upstream of the cooling stages in the initial cycle. A major portion of the water is routinely removed as a liquid via two-phase gas-liquid separation following gas compression and cooling upstream of the initial cooling cycle and also downstream of the first cooling stage in the initial cooling cycle. Mercury is routinely removed via mercury sorbent beds. Residual amounts of water and acid gases are routinely removed via the use of properly selected sorbent beds such as regenerable molecular sieves.

The pretreated natural gas feed stream is generally delivered to the liquefaction process at an elevated pressure or is compressed to an elevated pressure generally greater than 500 psia, preferably about 500 psia to about 3000 psia, still more preferably about 500 psia to about 1000 psia, still yet more preferably about 600 psia to about 800 psia. The feed stream temperature is typically near ambient to slightly above ambient. A representative temperature range being 60° F. to 150° F.

As previously noted, the natural gas feed stream is cooled in a plurality of multistage cycles or steps (preferably three) by indirect heat exchange with a plurality of different refrigerants (preferably three). The overall cooling efficiency for a given cycle improves as the number of stages increases but this increase in efficiency is accompanied by corresponding increases in net capital cost and process complexity. The feed gas is preferably passed through an effective number of refrigeration stages, nominally two, preferably two to four, and more preferably three stages, in the first closed refrigeration cycle utilizing a relatively high boiling refrigerant. Such relatively high boiling point refrigerant is preferably comprised in major portion of propane, propylene, or mixtures thereof, more preferably the refrigerant comprises at least about 75 mole percent propane, even more preferably at least 90 mole percent propane, and most preferably the refrigerant consists essentially of propane. Thereafter, the processed feed gas flows through an effective number of stages, nominally two, preferably two to four, and more preferably two or three, in a second closed refrigeration cycle in heat exchange with a refrigerant having a lower boiling point. Such lower boiling point refrigerant is preferably comprised in major portion of ethane, ethylene, or mixtures thereof, more preferably the refrigerant comprises at least about 75 mole percent ethylene, even more preferably at least 90 mole percent ethylene, and most preferably the refrigerant consists essentially of ethylene. Each cooling stage comprises a separate cooling zone. As previously noted, the processed natural gas feed stream is preferably combined with one or more recycle streams (i.e., compressed open methane cycle gas streams) at various locations in the second cycle thereby producing a liquefaction stream. In the last stage of the second cooling cycle, the liquefaction stream is condensed (i.e., liquefied) in major portion, preferably in its entirety, thereby producing a pressurized LNG-bearing stream. Generally, the process pressure at this location is only slightly lower than the pressure of the pretreated feed gas to the first stage of the first cycle.

Generally, the natural gas feed stream will contain such quantities of $C_2$+ components so as to result in the formation of a $C_2$+ rich liquid in one or more of the cooling stages. This liquid is removed via gas-liquid separation means, preferably one or more conventional gas-liquid separators. Generally, the sequential cooling of the natural gas in each stage is controlled so as to remove as much of the $C_2$ and higher molecular weight hydrocarbons as possible from the gas to produce a gas stream predominating in methane and a liquid stream containing significant amounts of ethane and heavier components. An effective number of gas/liquid separation means are located at strategic locations downstream of the cooling zones for the removal of liquids streams rich in $C_2$+ components. The exact locations and number of gas/liquid separation means, preferably conventional gas/liquid separators, will be dependant on a number of operating parameters, such as the $C_2$+ composition of the natural gas feed stream, the desired BTU content of the LNG product, the value of the $C_2$+ components for other applications, and other factors routinely considered by those skilled in the art of LNG plant and gas plant operation. The $C_2$+ hydrocarbon stream or streams may be demethanized via a single stage flash or a fractionation column. In the latter case, the resulting methane-rich stream can be directly returned at pressure to the liquefaction process. In the former case, this methane-rich stream can be repressurized and recycle or can be used as fuel gas. The $C_2$+ hydrocarbon stream or streams or the demethanized $C_2$+ hydrocarbon stream may be used as fuel or may be further processed, such as by fractionation in one or more fractionation zones to produce individual streams rich in specific chemical constituents (e.g., $C_2$, $C_3$, $C_4$ and $C_5$+).

The pressurized LNG-bearing stream is then further cooled in a third cycle or step referred to as the open methane cycle via contact in a main methane economizer with flash gases (i.e., flash gas streams) generated in this third cycle in a manner to be described later and via sequential expansion of the pressurized LNG-bearing stream to near atmospheric pressure. The flash gasses used as a refrigerant in the third refrigeration cycle are preferably comprised in major portion of methane, more preferably the flash gas refrigerant comprises at least 75 mole percent methane, still more preferably at least 90 mole percent methane, and most preferably the refrigerant consists essentially of methane. During expansion of the pressurized LNG-bearing stream to near atmospheric pressure, the pressurized LNG-bearing stream is cooled via at least one, preferably two to four, and more preferably three expansions where each expansion employs an expander as a pressure reduction means. Suitable expanders include, for example, either Joule-Thomson expansion valves or hydraulic expanders. The expansion is followed by a separation of the gas-liquid product with a separator. When a hydraulic expander is employed and properly operated, the greater efficiencies associated with the recovery of power, a greater reduction in stream temperature, and the production of less vapor during the flash expansion step will frequently more than off-set the higher capital and operating costs associated with the expander. In one embodiment, additional cooling of the pressurized LNG-bearing stream prior to flashing is made possible by first flashing a portion of this stream via one or more hydraulic expanders and then via indirect heat exchange means employing said flash gas stream to cool the remaining portion of the pressurized LNG-bearing stream prior to flashing. The warmed flash gas stream is then recycled via return to an appropriate location, based on temperature and pressure considerations, in the open methane cycle and will be recompressed.

The liquefaction process described herein may use one of several types of cooling which include but are not limited to (a) indirect heat exchange, (b) vaporization, and (c) expansion or pressure reduction. Indirect heat exchange, as used herein, refers to a process wherein the refrigerant cools the substance to be cooled without actual physical contact between the refrigerating agent and the substance to be cooled. Specific examples of indirect heat exchange means include heat exchange undergone in a shell-and-tube heat exchanger, a core-in-kettle heat exchanger, and a brazed aluminum plate-fin heat exchanger. The physical state of the refrigerant and substance to be cooled can vary depending on the demands of the system and the type of heat exchanger chosen. Thus, a shell-and-tube heat exchanger will typically be utilized where the refrigerating agent is in a liquid state and the substance to be cooled is in a liquid or gaseous state or when one of the substances undergoes a phase change and process conditions do not favor the use of a core-in-kettle heat exchanger. As an example, aluminum and aluminum alloys are preferred materials of construction for the core but such materials may not be suitable for use at the designated process conditions. A plate-fin heat exchanger will typically be utilized where the refrigerant is in a gaseous state and the substance to be cooled is in a liquid or gaseous state. Finally, the core-in-kettle heat exchanger will typically be utilized where the substance to be cooled is liquid or gas and the refrigerant undergoes a phase change from a liquid state to a gaseous state during the heat exchange.

Vaporization cooling refers to the cooling of a substance by the evaporation or vaporization of a portion of the substance with the system maintained at a constant pressure. Thus, during the vaporization, the portion of the substance which evaporates absorbs heat from the portion of the substance which remains in a liquid state and hence, cools the liquid portion. Finally, expansion or pressure reduction cooling refers to cooling which occurs when the pressure of a gas, liquid or a two-phase system is decreased by passing through a pressure reduction means. In one embodiment, this expansion means is a Joule-Thomson expansion valve. In another embodiment, the expansion means is either a hydraulic or gas expander. Because expanders recover work energy from the expansion process, lower process stream temperatures are possible upon expansion.

Figure 1:
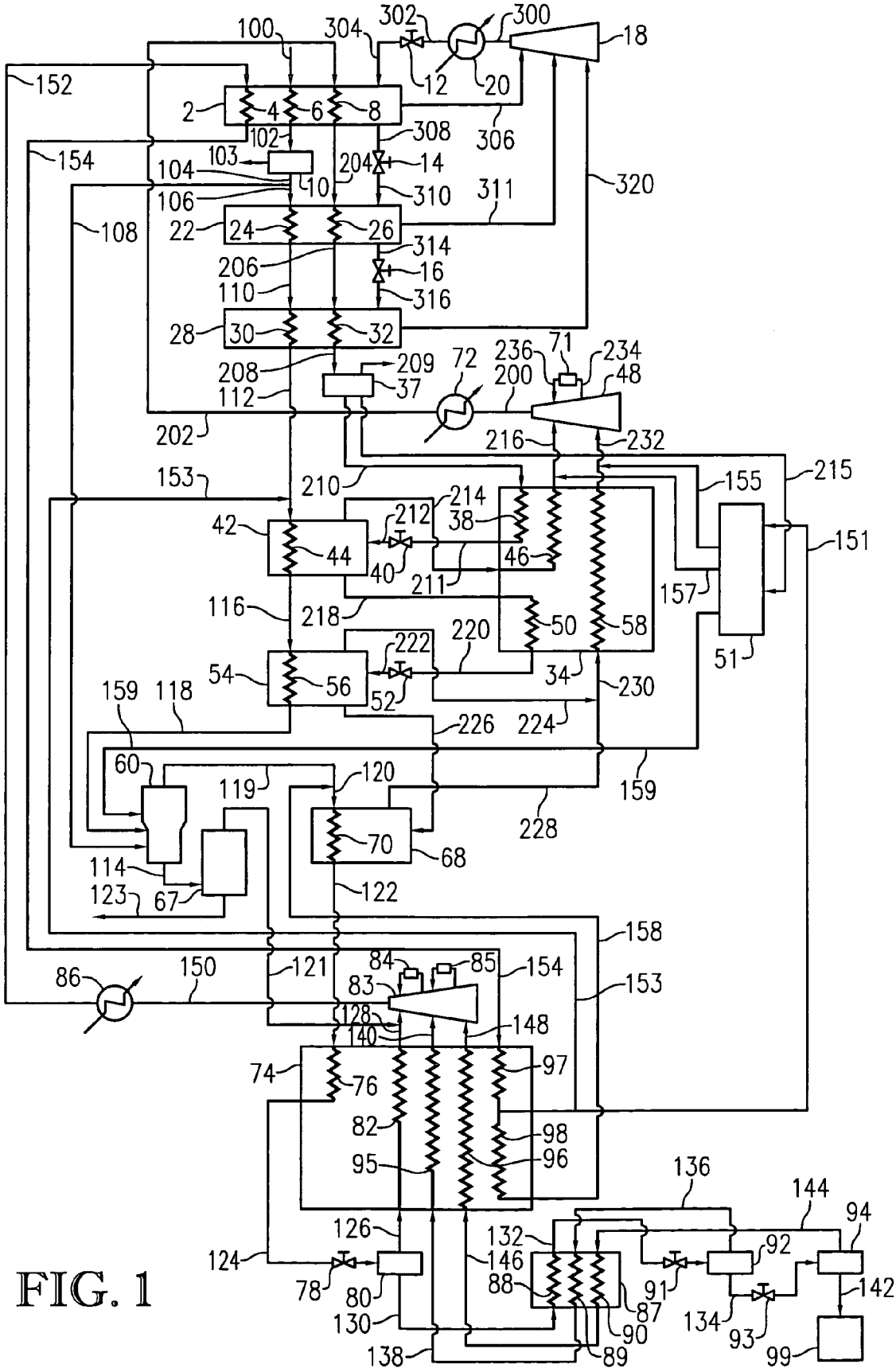
FIG. 1 is a simplified flow diagram of a cascaded-type LNG facility employing a refluxed heavies removal column and a reflux tower for provided the reflux stream to the heavies removal column.
Figure 2:
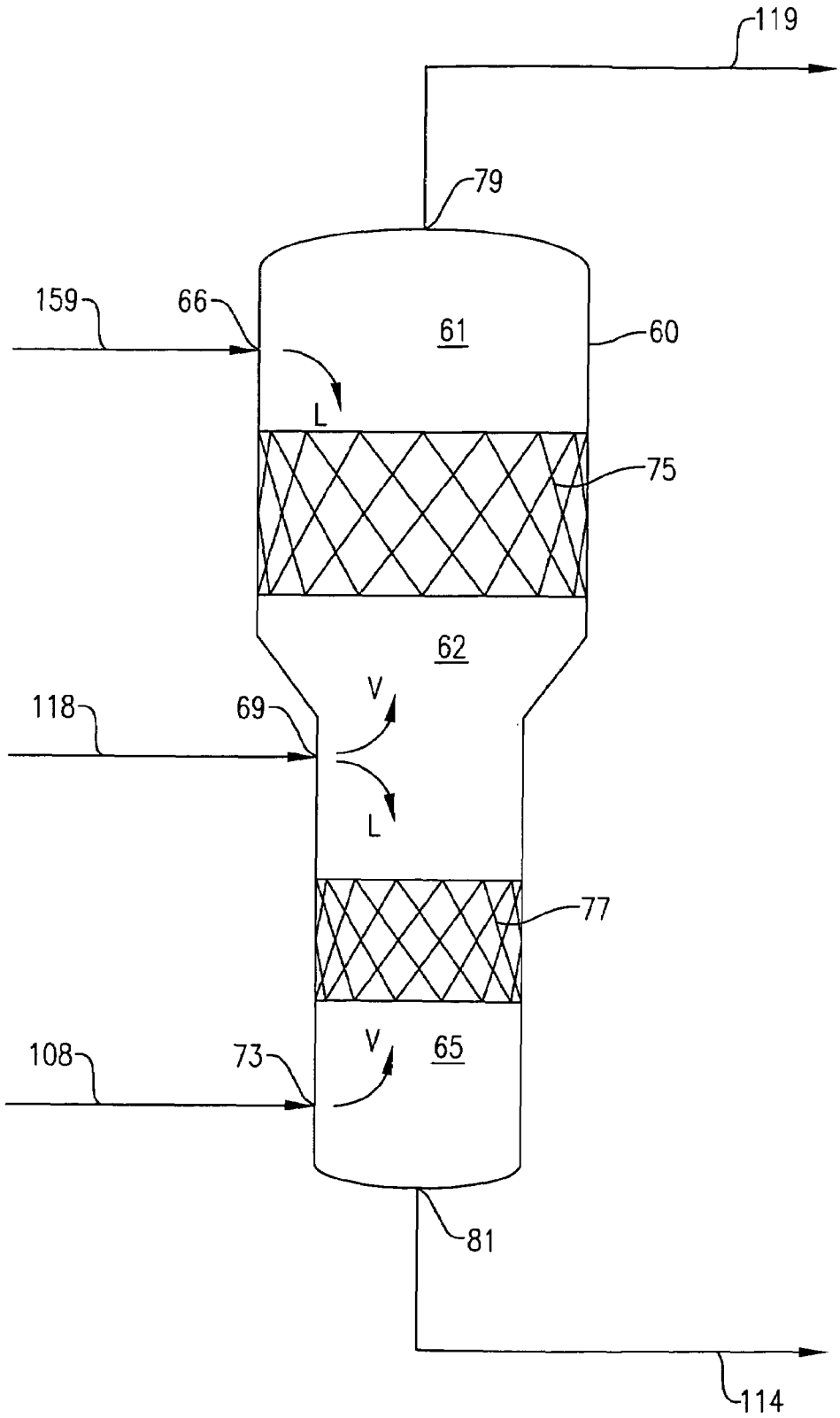
FIG. 2 is a sectional side view of a refluxed heavies removal column.

The flow schematic and apparatus set forth in FIG. 1 represents a preferred embodiment of an LNG facility in which the present invention can be employed. FIG. 2 illustrates a preferred embodiment of a refluxed heavies removal column for use with the methodology of the present invention. Those skilled in the art will recognized that FIGS.

1 and 2 are schematics only and, therefore, many items of equipment that would be needed in a commercial plant for successful operation have been omitted for the sake of clarity. Such items might include, for example, compressor controls, flow and level measurements and corresponding controllers, temperature and pressure controls, pumps, motors, filters, additional heat exchangers, and valves, etc. These items would be provided in accordance with standard engineering practice.

To facilitate an understanding of FIGS. 1 and 2, the following numbering nomenclature was employed. Items numbered 1 through 99 are process vessels and equipment which are directly associated with the liquefaction process. Items numbered 100 through 199 correspond to flow lines or conduits which contain predominantly methane streams. Items numbered 200 through 299 correspond to flow lines or conduits which contain predominantly ethylene streams. Items numbered 300 through 399 correspond to flow lines or conduits which contain predominantly propane streams.

Referring to FIG. 1, during normal operation of the LNG facility, gaseous propane is compressed in a multistage (preferably three-stage) compressor 18 driven by a gas turbine driver (not illustrated). The three stages of compression preferably exist in a single unit although each stage of compression may be a separate unit and the units mechanically coupled to be driven by a single driver. Upon compression, the compressed propane is passed through conduit 300 to a cooler 20 where it is cooled and liquefied. A representative pressure and temperature of the liquefied propane refrigerant prior to flashing is about 100° F. and about 190 psia. The stream from cooler 20 is passed through conduit 302 to a pressure reduction means, illustrated as expansion valve 12, wherein the pressure of the liquefied propane is reduced, thereby evaporating or flashing a portion thereof. The resulting two-phase product then flows through conduit 304 into a high-stage propane chiller 2 wherein gaseous methane refrigerant introduced via conduit 152, natural gas feed introduced via conduit 100, and gaseous ethylene refrigerant introduced via conduit 202 are respectively cooled via indirect heat exchange means 4, 6, and 8, thereby producing cooled gas streams respectively produced via conduits 154, 102, and 204. The gas in conduit 154 is fed to a main methane economizer 74, which will be discussed in greater detail in a subsequent section, and wherein the stream is cooled via indirect heat exchange means 97. A portion of the stream cooled in heat exchange means 97 is removed from methane economizer 74 via conduit 155 and subsequently used, after further cooling, as a reflux stream in a heavies removal column 60, as discussed in greater detail below with reference to FIG. 2. The portion of the cooled stream from heat exchange means 97 that is not removed for use as a reflux stream is further cooled in indirect heat exchange means 98. The resulting cooled methane recycle stream produced via conduit 158 is then combined in conduit 120 with the heavies depleted (i.e., light-hydrocarbon rich) vapor stream from heavies removal column 60 and fed to an ethylene condenser 68.

The propane gas from chiller 2 is returned to compressor 18 through conduit 306. This gas is fed to the high-stage inlet port of compressor 18. The remaining liquid propane is passed through conduit 308, the pressure further reduced by passage through a pressure reduction means, illustrated as expansion valve 14, whereupon an additional portion of the liquefied propane is flashed. The resulting two-phase stream is then fed to an intermediate stage propane chiller 22 through conduit 310, thereby providing a coolant for chiller 22. The cooled feed gas stream from chiller 2 flows via conduit 102 to a knock-out vessel 10 wherein gas and liquid phases are separated. The liquid phase, which is rich in $C_3$+ components, is removed via conduit 103. The gaseous phase is removed via conduit 104 and then split into two separate streams which are conveyed via conduits 106 and 108. The stream in conduit 106 is fed to propane chiller 22. The stream in conduit 108 is employed as a stripping gas in refluxed heavies removal column 60 to aid in the removal of heavy hydrocarbon components from the processed natural gas stream, as discussed in more detail below with reference to FIG. 2. Ethylene refrigerant from chiller 2 is introduced to chiller 22 via conduit 204. In chiller 22, the feed gas stream, also referred to herein as a methane-rich stream, and the ethylene refrigerant streams are respectively cooled via indirect heat transfer means 24 and 26, thereby producing cooled methane-rich and ethylene refrigerant streams via conduits 110 and 206. The thus evaporated portion of the propane refrigerant is separated and passed through conduit 311 to the intermediate-stage inlet of compressor 18. Liquid propane refrigerant from chiller 22 is removed via conduit 314, flashed across a pressure reduction means, illustrated as expansion valve 16, and then fed to a low-stage propane chiller/condenser 28 via conduit 316.

As illustrated in FIG. 1, the methane-rich stream flows from intermediate-stage propane chiller 22 to the low-stage propane chiller/condenser 28 via conduit 110. In chiller 28, the stream is cooled via indirect heat exchange means 30. In a like manner, the ethylene refrigerant stream flows from the intermediate-stage propane chiller 22 to low-stage propane chiller/condenser 28 via conduit 206. In the latter, the ethylene refrigerant is totally condensed or condensed in nearly its entirety via indirect heat exchange means 32. The vaporized propane is removed from low-stage propane chiller/condenser 28 and returned to the low-stage inlet of compressor 18 via conduit 320.

As illustrated in FIG. 1, the methane-rich stream exiting low-stage propane chiller 28 is introduced to high-stage ethylene chiller 42 via conduit 112. Ethylene refrigerant exits low-stage propane chiller 28 via conduit 208 and is preferably fed to a separation vessel 37 wherein light components are removed via conduit 209 and condensed ethylene is removed via conduit 210. The ethylene refrigerant at this location in the process is generally at a temperature of about −24° F. and a pressure of about 285 psia. The ethylene refrigerant then flows to an ethylene economizer 34 wherein it is cooled via indirect heat exchange means 38, removed via conduit 211, and passed to a pressure reduction means, illustrated as an expansion valve 40, whereupon the refrigerant is flashed to a preselected temperature and pressure and fed to high-stage ethylene chiller 42 via conduit 212. Vapor is removed from chiller 42 via conduit 214 and routed to ethylene economizer 34 wherein the vapor functions as a coolant via indirect heat exchange means 46. The ethylene vapor is then removed from ethylene economizer 34 via conduit 216 and feed to the high-stage inlet of ethylene compressor 48. The ethylene refrigerant which is not vaporized in high-stage ethylene chiller 42 is removed via conduit 218 and returned to ethylene economizer 34 for further cooling via indirect heat exchange means 50, removed from ethylene economizer via conduit 220, and flashed in a pressure reduction means, illustrated as expansion valve 52, whereupon the resulting two-phase product is introduced into a low-stage ethylene chiller 54 via conduit 222.

After cooling in indirect heat exchange means 44, the methane-rich stream is removed from high-stage ethylene chiller 42 via conduit 116. The stream in conduit 116 is then carried to a feed inlet of heavies removal column 60 wherein heavy hydrocarbon components are removed from the methane-rich stream, as described in further detail below with reference to FIG. 2. A heavies-rich liquid stream containing a significant concentration of $C_4$+ hydrocarbons, such as benzene, toluene, xylene, cyclohexane, other aromatics, and/or heavier hydrocarbon components, is removed from the bottom of heavies removal column 60 via conduit 114. The heavies-rich stream in conduit 114 is subsequently separated into liquid and vapor portions or preferably is flashed or fractionated in vessel 67. In either case, a second heavies-rich liquid stream is produced via conduit 123 and a second methane-rich vapor stream is produced via conduit 121. In the preferred embodiment, which is illustrated in FIG. 1, the stream in conduit 121 is subsequently combined with a second stream delivered via conduit 128, and the combined stream fed to the high-stage inlet port of the methane compressor 83. High-stage ethylene chiller 42 also includes an indirect heat exchanger means 43 which receives and cools the stream withdrawn from methane economizer 74 via conduit 155, as discussed above. The resulting cooled stream from indirect heat exchanger means 43 is conducted via conduit 157 to low-stage ethylene chiller 54. In low-stage ethylene chiller 54 the stream from conduit 157 is cooled via indirect heat exchange means 56. After cooling in indirect heat exchange means 56, the stream exits low-stage ethylene chiller 54 and is carried via conduit 159 to a reflux inlet of heavies removal column 60 where it is employed as a reflux stream.

As previously noted, the gas in conduit 154 is fed to main methane economizer 74 wherein the stream is cooled via indirect heat exchange means 97. A portion of the cooled stream from heat exchange means 97 is then further cooled in indirect heat exchange means 98. The resulting cooled stream is removed from methane economizer 74 via conduit 158 and is thereafter combined with the heavies-depleted vapor stream exiting the top of heavies removal column 60, delivered via conduit 5,119, and 120, and fed to a low-stage ethylene condenser 68. In low-stage ethylene condenser 68, this stream is cooled and condensed via indirect heat exchange means 70 with the liquid effluent from low-stage ethylene chiller 54 which is routed to low-stage ethylene condenser 68 via conduit 226. The condensed methane-rich product from low-stage condenser 68 is produced via conduit 122. The vapor from low-stage ethylene chiller 54, withdrawn via conduit 224, and low-stage ethylene condenser 68, withdrawn via conduit 228, are combined and routed, via conduit 230, to ethylene economizer 34 wherein the vapors function as a coolant via indirect heat exchange means 58. The stream is then routed via conduit 232 from ethylene economizer 34 to the low-stage inlet of ethylene compressor 48.

As noted in FIG. 1, the compressor effluent from vapor introduced via the low-stage side of ethylene compressor 48 is removed via conduit 234, cooled via inter-stage cooler 71, and returned to compressor 48 via conduit 236 for injection with the high-stage stream present in conduit 216. Preferably, the two-stages are a single module although they may each be a separate module and the modules mechanically coupled to a common driver. The compressed ethylene product from compressor 48 is routed to a downstream cooler 72 via conduit 200. The product from cooler 72 flows via conduit 202 and is introduced, as previously discussed, to high-stage propane chiller 2.

The pressurized LNG-bearing stream, preferably a liquid stream in its entirety, in conduit 122 is preferably at a temperature in the range of from about −200 to about −50° F., more preferably in the range of from about −175 to about −100° F., most preferably in the range of from −150 to −125° F. The pressure of the stream in conduit 122 is preferably in the range of from about 500 to about 700 psia, most preferably in the range of from 550 to 725 psia. The stream in conduit 122 is directed to main methane economizer 74 wherein the stream is further cooled by indirect heat exchange means/heat exchanger pass 76 as hereinafter explained. It is preferred for main methane economizer 74 to include a plurality of heat exchanger passes which provide for the indirect exchange of heat between various predominantly methane streams in the economizer 74. Preferably, methane economizer 74 comprises one or more plate-fin heat exchangers. The cooled stream from heat exchanger pass 76 exits methane economizer 74 via conduit 124. It is preferred for the temperature of the stream in conduit 124 to be at least about 10° F. less than the temperature of the stream in conduit 122, more preferably at least about 25° F. less than the temperature of the stream in conduit 122. Most preferably, the temperature of the stream in conduit 124 is in the range of from about −200 to about −160° F. The pressure of the stream in conduit 124 is then reduced by a pressure reduction means, illustrated as expansion valve 78, which evaporates or flashes a portion of the gas stream thereby generating a two-phase stream. The two-phase stream from expansion valve 78 is then passed to high-stage methane flash drum 80 where it is separated into a flash gas stream discharged through conduit 126 and a liquid phase stream (i.e., pressurized LNG-bearing stream) discharged through conduit 130. The flash gas stream is then transferred to main methane economizer 74 via conduit 126 wherein the stream functions as a coolant in heat exchanger pass 82. The predominantly methane stream is warmed in heat exchanger pass 82, at least in part, by indirect heat exchange with the predominantly methane stream in heat exchanger pass 76. The warmed stream exits heat exchanger pass 82 and methane economizer 74 via conduit 128.

The liquid-phase stream exiting high-stage flash drum 80 via conduit 130 is passed through a second methane economizer 87 wherein the liquid is further cooled by downstream flash vapors via indirect heat exchange means 88. The cooled liquid exits second methane economizer 87 via conduit 132 and is expanded or flashed via pressure reduction means, illustrated as expansion valve 91, to further reduce the pressure and, at the same time, vaporize a second portion thereof. This two-phase stream is then passed to an intermediate-stage methane flash drum 92 where the stream is separated into a gas phase passing through conduit 136 and a liquid phase passing through conduit 134. The gas phase flows through conduit 136 to second methane economizer 87 wherein the vapor cools the liquid introduced to economizer 87 via conduit 130 via indirect heat exchanger means 89. Conduit 138 serves as a flow conduit between indirect heat exchange means 89 in second methane economizer 87 and heat exchanger pass 95 in main methane economizer 74. The warmed vapor stream from heat exchanger pass 95 exits main methane economizer 74 via conduit 140, is combined with the first nitrogen-reduced stream in conduit 406, and the combined stream is conducted to the intermediate-stage inlet of methane compressor 83.

The liquid phase exiting intermediate-stage flash drum 92 via conduit 134 is further reduced in pressure by passage through a pressure reduction means, illustrated as a expansion valve 93. Again, a third portion of the liquefied gas is evaporated or flashed. The two-phase stream from expansion valve 93 are passed to a final or low-stage flash drum 94. In flash drum 94, a vapor phase is separated and passed through conduit 144 to second methane economizer 87 wherein the vapor functions as a coolant via indirect heat exchange means 90, exits second methane economizer 87 via conduit 146, which is connected to the first methane economizer 74 wherein the vapor functions as a coolant via heat exchanger pass 96. The warmed vapor stream from heat exchanger pass 96 exits main methane economizer 74 via conduit 148, is combined with the second nitrogen-reduced stream in conduit 408, and the combined stream is conducted to the low-stage inlet of compressor 83.

The liquefied natural gas product from low-stage flash drum 94, which is at approximately atmospheric pressure, is passed through conduit 142 to a LNG storage tank 99. In accordance with conventional practice, the liquefied natural gas in storage tank 99 can be transported to a desired location (typically via an ocean-going LNG tanker). The LNG can then be vaporized at an onshore LNG terminal for transport in the gaseous state via conventional natural gas pipelines.

As shown in FIG. 1, the high, intermediate, and low stages of compressor 83 are preferably combined as single unit. However, each stage may exist as a separate unit where the units are mechanically coupled together to be driven by a single driver. The compressed gas from the low-stage section passes through an inter-stage cooler 85 and is combined with the intermediate pressure gas in conduit 140 prior to the second-stage of compression. The compressed gas from the intermediate stage of compressor 83 is passed through an inter-stage cooler 84 and is combined with the high pressure gas provided via conduits 121 and 128 prior to the third-stage of compression. The compressed gas (i.e., compressed open methane cycle gas stream) is discharged from high stage methane compressor through conduit 150, is cooled in cooler 86, and is routed to the high pressure propane chiller 2 via conduit 152 as previously discussed. The stream is cooled in chiller 2 via indirect heat exchange means 4 and flows to main methane economizer 74 via conduit 154. The compressed open methane cycle gas stream from chiller 2 which enters the main methane economizer 74 undergoes cooling in its entirety via flow through indirect heat exchange means 98. This cooled stream is then removed via conduit 158 and combined with the processed natural gas feed stream upstream of the first stage of ethylene cooling.

Referring now to FIG. 2, refluxed heavies column 60 is shown in more detail. As used herein, the term "heavies removal column" shall denote a vessel operable to separate a heavy component(s) of a hydrocarbon-containing stream from a lighter component(s) of the hydrocarbon-containing stream. As used herein, the term "refluxed heavies removal column" shall denote a heavies removal column that employs a reflux stream to aid in separating heavy and light hydrocarbon components. Refluxed heavies removal column 60 generally includes an upper zone 61, a middle zone 62, and a lower zone 65. Upper zone 61 receives the reflux stream in conduit 159 via a reflux inlet 66. Middle zone 62 receives the processed natural gas stream in conduit 118 via a feed inlet 69. Lower zone 65 receives the stripping gas stream in conduit 108 via a stripping gas inlet 73. Upper zone 61 and middle zone 62 are separated by upper internal packing 75, while middle zone 62 and lower zone 65 are separated by lower internal packing 77. Internal packing 75,77 can be any conventional structure known in the art for enhancing contact between two countercurrent streams in a vessel. Refluxed heavies removal column 60 also includes an upper outlet 79 and a lower outlet 81.

Referring again to FIG. 2, during normal operation of heavies removal column 60, the feed stream enters middle zone 62 of heavies removal column 60 via feed inlet 69, the reflux stream enters upper zone 61 of heavies removal column 60 via reflux inlet 66, and the stripping gas stream enters lower zone 65 of heavies removal column 60 via stripping gas inlet 73. The downwardly flowing liquid reflux stream is contacted in upper internal packing 75 with the upwardly flowing vapor portion of the feed stream, while the downwardly flowing liquid portion of the feed stream is contacted in lower internal packing 77 with the upward flowing stripping gas. In this manner, heavies removal column 60 is operable to produce a heavies-depleted (i.e., lights-rich) stream via upper outlet 79 and a heavies-rich stream via lower outlet 81 during normal operation. During normal operation, the feed introduced into heavies removal column 60 via feed inlet 69 typically has a $C_5$+ concentration of at least 0.1 mole percent, a $C_4$ concentration of at least 2 mole percent, a benzene concentration of at least 4 ppmw (parts per million by weight), a cyclohexane concentration of at least 4 ppmw, and/or a combined concentration of xylene and toluene of at least 10 ppmw. The heavies-depleted stream exiting heavies removal column 60 via upper outlet 79 preferably has a lower concentration of $C_4$+ hydrocarbon components than the feed entering inlet 69, more preferably the heavies-depleted stream exiting upper outlet 79 has a $C_5$+ concentration of less than 0.1 mole percent, a $C_4$ concentration of less than 2 mole percent, a benzene concentration of less than 4 ppmw, a cyclohexane concentration of less than 4 ppmw, and a combined concentration of xylene and toluene of less than 10 ppmw. During normal operation, the heavies-rich stream exiting heavies removal column 60 via lower outlet 81 preferably has a higher concentration of $C_4$+ hydrocarbons than the feed entering feed inlet 69. It is preferred for the stripping gas entering heavies removal column 60 via stripping gas inlet 66 to comprise a higher proportion of light hydrocarbons than the feed to feed inlet 69 of heavies removal column 60. More preferably, the reflux stream entering reflux inlet 66 of heavies removal column 60 during normal operation comprises at least about 90 mole percent methane, still more preferably at least about 95 mole percent methane, and most preferably at least 97 mole percent methane. It is preferred for the stripping gas entering heavies removal column 60 via stripping gas inlet 73 to have substantially the same composition as the feed stream entering heavies removal column 60 via feed inlet 69.

As used herein, the term "vapor/liquid hydrocarbon separation point" or simply "hydrocarbon separation point" shall be used to identify a point of separation between the vapor and liquid phases of a hydrocarbon-containing stream based on the number of carbon atoms in the hydrocarbon molecules of the phases. When the hydrocarbon separation point is represented by the formula $C_{X(X+1)}$, then a predominant molar portion of $C_X$− hydrocarbon molecules are present in the vapor phase while a predominant molar portion of $C_{(X+1)}$+ hydrocarbon molecules are present in the liquid phase. For example, if the hydrocarbon separation point of a certain two-phase hydrocarbon-containing stream is $C_{4/5}$, then a predominant portion (i.e., more than 50 mole percent) of the $C_5$+ hydrocarbons are present in the liquid phase while a predominant molar portion of the $C_4$− hydrocarbons are present in the vapor phase. In other words, if the hydrocarbon separation point is $C_{4/5}$, the vapor phase would contain more than 50 mole percent of the $C_4$ hydrocarbons present in the two-phase stream, more than 50 mole percent of the $C_3$ hydrocarbons present in the two-phase stream, more than 50 mole percent of the $C_2$ hydrocarbons present in the two-phase stream, and more than 50 mole percent of the $C_1$ hydrocarbons present in the two-phase stream, while the liquid phase would contain more than 50 mole percent of the $C_5$, $C_6$, $C_7$, $C_8$ etc. hydrocarbons present in the two-phase stream.

During normal operation of operation, the stream entering feed inlet 69 of heavies removal column 60 preferably has a hydrocarbon separation point which can be represented as follows: $C_{Y/(Y+1)}$, wherein Y is an integer in the range of from 2 to 10. More preferably, Y is in the range of from 4 to 8, still more preferably in the range of from 5 to 7, and most preferably Y is 6. Preferably, Y is at least 1 greater than X. Most preferably, Y is 2 greater than X. When the feed to inlet 69 of heavies removal column 60 has the above-described hydrocarbon separation point, optimal heavies removal can be achieved during normal operation.

During the normal operational mode, it is preferred for the temperature of the reflux stream entering heavies removal column 60 via reflux inlet 66 to be cooler than the temperature of the feed stream entering heavies removal column 60 via feed inlet 69, more preferably at least about 5° F. cooler, still more preferably at least about 15° F. cooler, and most preferably at least 35° F. cooler. Preferably, the temperature of the reflux stream entering reflux inlet 66 of heavies removal column 60 is in the range of from about −160 to about −100° F., more preferably in the range of from about −145 to about −120° F., most preferably in the range of from −138 to −125° F. It is preferred for the temperature of the stripping gas stream entering heavies removal column 60 via stripping gas inlet 73 to be warmer than the temperature of the feed stream entering heavies removal column 60 via feed inlet 69, more preferably at least about 5° F. warmer, still more preferably at least about 20° F. warmer, and most preferably at least 40° F. warmer. Preferably, the temperature of the stripping gas stream entering stripping gas inlet 66 of heavies removal column 60 is in the range of from about −75 to about −0° F., more preferably in the range of from about −60 to about −15° F., most preferably in the range of from −40 to −30° F.

Figure 3:
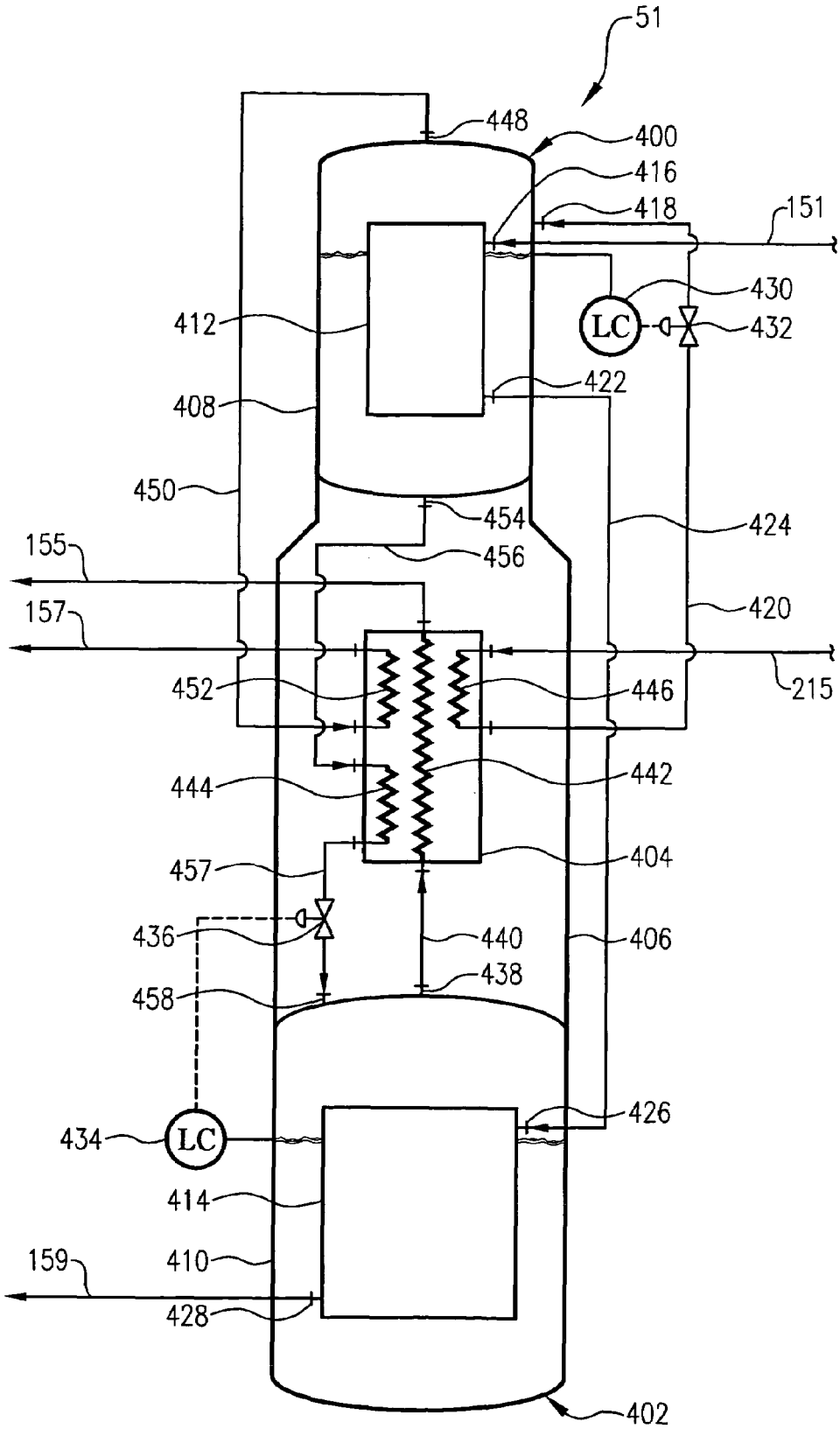
FIG. 3 is a sechematic side view of a reflux tower employ stacked, vertical core-in-kettle heat exchangers.

Referring now to FIG. 3, reflux tower 51 is illustrated a generally comprising an upper vertical core-in-kettle heat exchanger 400, a lower vertical core-in-kettle heat exchanger 402, and a refrigerant economizer 404. Upper heat exchanger 400 is vertically disposed above lower heat exchanger 402, while ecomonizer is disposed generally between upper and lower heat exchangers 400,402. Thus, the main components of reflux tower 41 have a stacked configuration which allows the reflux tower to occupy minimal plot space. A support structure 406 supports the heat exchangers 400, 402 and the economizer 404 in the stacked configuration.

Upper and lower heat exchangers 400,402 include respective shells 408,410 and cores 412,414. Heat exchangers 400,402 are operable to facilitate indirect heat transfer between a shell-side fluid received in the shells 408,410 and a core-side fluid received in the cores 412,414. Upper and lower heat exchanger 400,402 preferably have a substantially similar configuration. The specific configuration of upper and lower vertical core-in-kettle heat exchangers will be describe in detail below with reference to FIGS. 4-6.

As shown in FIG. 3, the pressurized methane-rich stream in conduit 151 is received in upper core 412 via upper core inlet 416, where the methane-rich stream is cooled by indirect heat exchange with the predominately-ethylene refrigerant stream entering the internal volume of upper shell 408 via an upper shell inlet 418. The predominately-ethylene refrigerant steam employed in upper heat exchanger 400 originates from conduit 215 and is first cooled in economizer 404 prior to being conducted to upper heat exchanger 400 via conduit 420. In upper heat exchanger 400, heat is transferred from the methane-rich stream in upper core 412 to the ethylene refrigerant in upper shell 408. The resulting cooled methane-rich steam exits upper core 412 via upper core outlet 422 and is conducted via conduit 424 to lower heat exchanger 402 for introduction into lower core 414 via lower core inlet 426. In lower heat exchanger 402, heat is transferred from the methane-rich stream in lower core 414 to the predominately-ethylene refrigerant in lower shell 410. The resulting cooled, liquified, pressurized, methane-rich stream exits lower core 414 via lower core outlet 428 and is transported via conduit 159 to heavies removal column 60 (FIG. 1) for use as the liquid reflux stream.

Referring again to FIG. 3, the indirect transfer of heat from the predominately-ethylene refrigerant in upper shell 408 to the methane-rich stream in upper core 412 causes vaporization of a portion of the ethylene refrigerant so that gaseous and liquid ethylene refrigerant coexist in upper shell 408. It is preferred for upper core 412 to be partially submerged in the liquid-phase refrigerant in upper shell 408. The liquid-phase refrigerant in upper shell 408 may be maintained at the desired level relative to upper core 412 by employing a level controller 430 operably coupled to a flow control valve 432 which controls the flow rate of ethylene refrigerant through conduit 420 and into upper shell 408. Similarly, the indirect transfer of heat from the predominately-ethylene refrigerant in lower shell 410 to the methane-rich stream in lower core 414 causes vaporization of a portion of the ethylene refrigerant so that gaseous and liquid ethylene refrigerant coexist in lower shell 410. It is preferred for lower core 414 to be partially submerged in the liquid-phase refrigerant in lower shell 410. The liquid-phase refrigerant in lower shell 410 may be maintained at the desired level relative to lower core 414 by employing a level controller 434 operably coupled to a flow control valve 436 which controls the flow rate of ethylene refrigerant into lower shell 408.

The gaseous/vaporized ethylene refrigerant in lower shell 410 exits lower heat exchanger 502 via lower shell outlet 438 and is conducted to economizer 404 via conduit 440. This gaseous ethylene refrigerant stream is then employed as a cooling fluid in a first heat exchange pass 442 of economizer 404. In first heat exchange pass 442, the refrigerant steam is warmed via indirect heat exchange with the refrigerant streams in second and third heat exchange passes 444,446. The resulting warmed refrigerant stream from first heat exchange pass 442 is conducted via conduit to 155 to the low-stage inlet of ethylene compressor 48 (FIG. 1).

The gaseous/vaporized ethylene refrigerant in upper shell 408 exits upper heat exchanger 500 via an upper vapor shell outlet 448 and is conducted to economizer 404 via conduit 450. This gaseous ethylene refrigerant stream is then employed as a cooling fluid in a fourth heat exchange pass 452 of economizer 404. In fourth heat exchange pass 452, the refrigerant steam is warmed via indirect heat exchange with the refrigerant streams in second and third heat exchange passes 444,446. The resulting warmed refrigerant stream from fourth heat exchange pass 452 is conducted via conduit to 157 to the high-stage inlet of ethylene compressor 48 (FIG. 1). The liquid-phase ethylene refrigerant in upper shell 408 exits upper heat exchanger 500 via an upper liquid shell outlet 454 and is conducted to economizer 404 via conduit 456. This liquid ethylene refrigerant is then cooled in second heat exchange pass 6344, as described above, and conducted to a lower shell inlet 458 of lower shell 410 to further cool the methane rich stream in lower core 414. As described above, fourth heat exchange pass 6346 of economizer 404 is used to pre-cool the ethylene refrigerant in conduit 215 prior to introduction into upper shell 408 of upper heat exchanger 500.

Referring now to FIGS. 4-6, a preferred configuration of vertical core-in-kettle heat exchangers 500,502 (FIG. 3) will now be described in detail. It is preferred for both heat exchangers 500,502 (FIG. 3) to have a configuration similar to that of vertical core in kettle heat exchanger 600, illustrated in FIGS. 406. As shown in FIG. 4, vertical core-in-kettle heat exchanger 600 is illustrated as generally comprising a shell 602 and a core 604. Shell 602 includes a substantially cylindrical sidewall 606, an upper end cap 608, and a lower end cap 610. Upper and lower end caps 608,610 are coupled to generally opposite ends of sidewall 606. Sidewall 606 extends along a central sidewall axis 612 that is maintained in a substantially upright position when heat exchanger 600 is in service. Any conventional support system 313*a,b* can be used to maintain the upright orientation of shell 602. Shell 602 defines an internal volume 614 for receiving core 604 and a shell-side fluid (A). Sidewall 606 defines a shell-side fluid inlet 616 for introducing the shell-side fluid feed stream ($A_{in}$) into internal volume 614. Upper end cap 608 defines a vapor outlet 618 for discharging the gaseous/vaporized shell-side fluid ($A_{V\text{-}out}$) from internal volume 614, while lower end cap 610 defines a liquid outlet 620 for discharging the liquid shell-side fluid ($A_{L\text{-}out}$) from internal volume 614.

Core 604 of heat exchanger 600 is disposed in internal volume 614 of shell 602 and is partially submerged in the liquid shell-side fluid (A). Core 604 receives a core-side fluid (B) and facilitates indirect heat transfer between the core side fluid (B) and the shell-side fluid (A). A core-side fluid inlet 622 extends through sidewall 606 of shell 602 and is fluidly coupled to an inlet header 624 of core 604 to thereby provide for introduction of the core-side fluid feed stream ($B_{in}$) into core 604. A core-side fluid outlet 626 is fluidly coupled to an outlet header 628 of core 604 and extends through sidewall 606 of shell 602 to thereby provide for the discharge of the core-side fluid ($B_{out}$) from core 604.

As perhaps best illustrated in FIGS. 2 and 3, core 604 preferably comprises a plurality of spaced-apart plate/fin dividers 630 defining fluid passageways therebetween. Preferably, dividers 630 define a plurality of alternating, fluidly-isolated core-side passageways 632*a,b* and shell-side passageways 634*a,b*. It is preferred for the core-side and shell-side passageways 632,634 to extend in a direction that is substantially parallel to the direction of extension of central sidewall axis 612. Core-side passageways 632 receive the core-side fluid (B) from inlet header 624 and discharge the core-side fluid (B) into outlet header 628. Shell-side passageways 634 include opposite open ends that provide for fluid communication with internal volume 614 of shell 602.

As illustrated in FIG. 3, the shell-side fluid (A) and the core-side fluid (B) flow in a counter-current manner through shell-side and core side passageways 634,632 of core 604. Preferably, the core-side fluid (B) flows generally downwardly through core-side passageways 632, while the shell-side fluid (A) flows generally upwardly through the shell-side passageways 634. The downward flow the core-side fluid (B) through core is provided by any conventional means such as, for example, by mechanically pumping the fluid (B) to core-side fluid inlet 622 at elevated pressure. The upward flow of the shell-side fluid (A) through core 604 is provided by a unique mechanism know in the art as the "thermosiphon effect". A thermosiphon effect is caused by the boiling of a liquid within an upright flow channel. When a liquid is heated in an open-ended upright flow channel until the liquid begins to boil, the resulting vapors rise through the flow channel due to natural buoyant forces. This rising of the vapors through the upright flow channel causes a siphoning effect on the liquid in the lower portion of the flow channel. If the lower open end of the flow channel is continuously supplied with liquid, a continuous upward flow of the liquid through the flow channel is provided by this thermosiphon effect.

Referring to FIGS. 1-3, the thermosiphon effect provided in heat exchanger 600 acts as a natural convection pump that circulates the shell-side fluid (A) through and around core 604 to thereby enhance indirect heat exchange in core 604. The thermosiphon effect causes the shell-side fluid (A) to vaporize within shell-side passageways 634 of core 604. In order to generate an optimum thermosiphon effect, a majority of core 604 should be submerged in the liquid shell-side fluid (A) below the liquid surface level 636. In order to ensure proper availability of the liquid shell-side fluid (A) to the lower openings of shell-side passageways 634, it is preferred for a substantial space to be provided between the bottom of core 604 and the bottom of internal volume 614. In order to ensure proper disengagement of the entrained liquid-phase shell side fluid in the gaseous shell-side fluid exiting vapor outlet 618, it is preferred for a substantial space to be provided between the top of core 604 and the top of internal volume 614. In order to ensure proper circulation of the liquid shell-side fluid (A) around core 604, it is preferred for a substantial space to be provided between the sides of core 604 and sidewall 606 of shell 602. The above mentioned advantages may be realized by constructing heat exchanger 600 with the dimensions/ratios illustrated in FIG. 1 and quantified in Table 1, below.

TABLE 1

Preferred Dimensions and Ratios of Heat Exchanger 600 (FIG. 1)

| Dimension or Ratio | Units | Preferred Range | More Preferred Range | Most Preferred Ranged |
|---|---|---|---|---|
| $X_1$ | ft. | 1-620 | 4-610 | 6-15 |
| $X_2$ | ft. | 0.5-610 | 2-15 | 4-600 |
| $Y_1$ | ft. | 2-60 | 6-40 | 8-620 |
| $Y_2$ | ft. | 1-40 | 3-620 | 5-610 |
| $Y_3$ | ft. | >2 | >4 | 5-600 |
| $Y_4$ | ft. | >2 | >4 | 5-600 |
| $Y_1/X_1$ | — | >1 | >1.25 | 1.5-3 |
| $Y_2/X_2$ | — | 0.25-4 | 0.5-2 | 0.75-1.5 |
| $X_2/X_1$ | — | <0.95 | <0.9 | 0.5-0.8 |
| $Y_2/Y_1$ | — | <0.75 | <0.6 | 0.25-0.5 |
| $Y_3/Y_1$ | — | >0.15 | >0.2 | 0.25-0.4 |
| $Y_4/Y_1$ | — | >0.15 | >0.2 | 0.25-0.4 |
| $Y_5/Y_2$ | — | 0.5-1 | 0.6-0.9 | 0.7-0.85 |
| $Y_6/Y_2$ | — | 0.5-0.98 | 0.75-0.95 | 0.8-0.9 |

In FIG. 1, $X_1$ is the maximum width of reaction zone 614 measured perpendicular to the direction of extension of central sidewall axis 612; $X_2$ is the minimum width of core 604 measured perpendicular to the direction of extension of central sidewall axis 612: $Y_1$ is the maximum height of reaction zone 614 measured parallel to the direction of extension of central sidewall axis 612; $Y_2$ is the maximum height of core 604 measured parallel to the direction of extension of central sidewall axis 612; $Y_3$ is the maximum spacing between the bottom of core 604 and the bottom of reaction zone 614 measured parallel to the direction of extension of central sidewall axis 612; and $Y_4$ is the maximum spacing between the top of core 604 and the top of reaction zone 614 measured parallel to the direction of extension of central sidewall axis 612.

In a preferred embodiment of the present invention, heat exchanger 600 is a vertical core-in-kettle heat exchanger and core 604 is a brazed-aluminum, plate-fin core. As used herein, the term "core-in-kettle heat exchanger" shall denote a heat exchanger operable to facilitate indirect heat transfer between a shell-side fluid and a core-side fluid, wherein the heat exchanger comprises a shell for receiving the shell-side fluid and a core disposed in the shell for receiving the core-side fluid, wherein the core defines a plurality of spaced-apart core-side fluid passageways and the shell-side fluid is free to circulate through discrete shell-side passageways defined between the core-side passageways. One distinguishing feature between a core-in-kettle heat exchanger and a shell-and-tube heat exchanger is that a shell-and-tube heat exchanger does not have discrete shell-side passageways between the tubes. The discrete shell-side passageways of a core-in-kettle heat exchanger allow it to take full advantage of the thermosiphon effect. As used herein, the term "vertical core-in-kettle heat exchanger" shall denote a core-in-kettle heat exchanger having a shell that comprises a substantially cylindrical sidewall extending along a central sidewall axis wherin the central sidewall axis is maintained in a substantially upright position.

In one embodiment of the present invention, the LNG production systems illustrated in FIGS. 1 and 2 are simulated on a computer using conventional process simulation software. Examples of suitable simulation software include HYSYS™ from Hyprotech, Aspen Plus® from Aspen Technology, Inc., and PRO/II® from Simulation Sciences Inc.

The preferred forms of the invention described above are to be used as illustration only, and should not be used in a limiting sense to interpret the scope of the present invention. Obvious modifications to the exemplary embodiments, set forth above, could be readily made by those skilled in the art without departing from the spirit of the present invention.

The inventors hereby state their intent to rely on the Doctrine of Equivalents to determine and assess the reasonably fair scope of the present invention as pertains to any apparatus not materially departing from but outside the literal scope of the invention as set forth in the following claims.

What is claimed is:

1. A process for liquefying a natural gas stream, said process comprising:

(a) cooling the natural gas stream in at least one upstream heat exchanger of an upstream refrigeration cycle via indirect heat exchange with an upstream refrigerant;

(b) using a refluxed heavies removal column to remove heavy hydrocarbon components from the cooled natural gas stream;

(c) cooling the heavies-reduced natural gas stream in a methane refrigeration cycle via indirect heat exchange with a predominately methane refrigerant;

(d) cooling a portion of the predominately methane refrigerant via indirect heat exchange with the upstream refrigerant in a first core-in-kettle heat exchanger to thereby provide a cooled predominately methane stream, wherein the first core-in-kettle heat exchanger operates in parallel with said at least one upstream heat exchanger;

(e) employing at least a portion of the cooled predominately methane stream as a reflux stream in the refluxed heavies removal column;

(f) cooling at least a portion of the predominately methane refrigerant via indirect heat exchange with the upstream refrigerant in a second core-in-kettle heat exchanger;

(g) discharging a first gas-phase portion of the upstream refrigerant from the first heat exchanger;

(h) discharging a second liquid-phase portion of the upstream refrigerant from the second heat exchanger; and (i) facilitating indirect heat exchange between the first gas-phase portion and the second liquid-phase portion;

said first and second core-in-kettle heat exchangers being positioned in a stacked configuration with one of the heat exchangers locate above the other heat exchanger.

2. The process of claim 1, step (i) being carried out in an economizer vertically disposed between the first and second heat exchangers.

3. The process of claim 2, said economizer comprising a plate-fin heat exchanger.

4. The process of claim 2, said economizer comprising a brazed-aluminum, plate-fin heat exchanger.

5. The process of claim 2; and (j) prior to employing said upstream refrigerant in the second heat exchanger, cooling the upstream refrigerant in the economizer via indirect heat exchange with the first gas-phase portion.

6. The process of claim 2; and (k) discharging a second gas-phase portion of the upstream refrigerant from the second heat exchanger; and (l) cooling said second gas-phase portion in the economizer via indirect heat exchange with the first gas-phase portion.

7. A facility for liquefying a natural gas stream, said facility comprising:

a first refrigeration cycle comprising at least one upstream heat exchanger for cooling said natural gas stream via indirect heat exchange with a first refrigerant;

a second refrigeration cycle located downstream of the first refrigeration cycle and operable to cool the natural gas stream via indirect heat exchange with a second refrigerant of different composition than the first refrigerant; and a refluxed heavies removal column located downstream of said at least one upstream heat exchanger and operable to remove heavy hydrocarbon components from said natural gas stream, said first refrigeration cycle further comprising at least one reflux heat exchanger for cooling a reflux portion of said natural gas stream via indirect heat exchange with said first refrigerant and to thereby provide a cooled reflux stream for said heavies removal column, said at least one reflux heat exchanger and said at least one upstream heat exchanger operating in parallel with one another, said second refrigerant being derived from the natural gas stream, said reflux portion of the natural gas stream being derived from the second refrigerant.

8. A facility for liquefying a natural gas stream, said facility comprising:

a first refrigeration cycle comprising at least one upstream heat exchanger for cooling said natural gas stream via indirect heat exchange with a first refrigerant;

a second refrigeration cycle located downstream of the first refrigeration cycle and operable to cool the natural gas stream via indirect heat exchange with a second refrigerant of different composition than the first refrigerant; and a refluxed heavies removal column located downstream of said at least one upstream heat exchanger and operable to remove heavy hydrocarbon components from said natural gas stream, said first refrigeration cycle further comprising at least one reflux heat exchanger for cooling a reflux portion of said natural gas stream via indirect heat exchange with said first refrigerant and to thereby provide a cooled reflux stream for said heavies removal column, said at least one reflux heat exchanger and said at least one upstream heat exchanger operating in parallel with one another, said second refrigeration cycle comprising a compressor for compressing said second refrigerant, said reflux portion of the natural gas stream being derived from a portion of the second refrigerant that has been compressed in the compressor.

9. A facility for liquefying a natural gas stream, said facility comprising:

a first refrigeration cycle comprising at least one upstream heat exchanger for cooling said natural gas stream via indirect heat exchange with a first refrigerant;

a second refrigeration cycle located downstream of the first refrigeration cycle and operable to cool the natural gas stream via indirect heat exchange with a second refrigerant of different composition than the first refrigerant;

a third refrigeration cycle located upstream of the first refrigeration cycle and operable to cool the natural gas stream via indirect heat exchange with a third refrigerant of different composition than the first and second refrigerants; and a refluxed heavies removal column located downstream of said at least one upstream heat exchanger and operable to remove heavy hydrocarbon components from said natural gas stream, said first refrigeration cycle further comprising at least one reflux heat exchanger for cooling a reflux portion of said natural gas stream via indirect heat exchange with said first refrigerant and to thereby provide a cooled reflux stream for said heavies removal column, said at least one reflux heat exchanger and said at least one upstream heat exchanger operating in parallel with one another, said third refrigeration cycle being operable to cool at least a portion of the first refrigerant via indirect heat exchange with the third refrigerant.

10. A facility for liquefying a natural gas stream, said facility comprising:

a first refrigeration cycle comprising at least one upstream heat exchanger for cooling said natural gas stream via indirect heat exchange with a first refrigerant;

a second refrigeration cycle located downstream of the first refrigeration cycle and operable to cool the natural gas stream via indirect heat exchange with a second refrigerant of different composition than the first refrigerant;

a third refrigeration cycle located upstream of the first refrigeration cycle and operable to cool the natural gas stream via indirect heat exchange with a third refrigerant of different composition than the first and second refrigerants; and a refluxed heavies removal column located downstream of said at least one upstream heat exchanger and operable to remove heavy hydrocarbon components from said natural gas stream, said first refrigeration cycle further comprising at least one reflux heat exchanger for cooling a reflux portion of said natural gas stream via indirect heat exchange with said first refrigerant and to thereby provide a cooled reflux stream for said heavies removal column, said at least one reflux heat exchanger and said at least one upstream heat exchanger operating in parallel with one another, said third refrigeration cycle being operable to cool at least a portion of the second refrigerant via indirect heat exchange with the third refrigerant.

11. A facility for liquefying a natural gas stream, said facility comprising:

a first refrigeration cycle comprising at least one upstream heat exchanger for cooling said natural gas stream via indirect heat exchange with a first refrigerant; and a refluxed heavies removal column located downstream of said at least one upstream heat exchanger and operable to remove heavy hydrocarbon components from said natural gas stream, said first refrigeration cycle further comprising at least one reflux heat exchanger for cooling a reflux portion of said natural gas stream via indirect heat exchange with said first refrigerant and to thereby provide a cooled reflux stream for said heavies removal column, said at least one reflux heat exchanger and said at least one upstream heat exchanger operating in parallel with one another, said reflux heat exchanger comprising a first core-in-kettle heat exchanger, a second core-in-kettle heat exchanger, and an economizer, said economizer being fluidly coupled to the first and second heat exchangers and operable to facilitate indirect heat exchange between various streams entering and exiting the first and second heat exchangers, said first heat exchanger being vertically disposed above said second heat exchanger, said economizer being vertically disposed between said first and second heat exchangers.

* * * * *